US009181075B2

(12) United States Patent
Hsu

(10) Patent No.: US 9,181,075 B2
(45) Date of Patent: Nov. 10, 2015

(54) WATER CONTAINER

(71) Applicant: Chi Mei Communication Systems, Inc., New Taipei (TW)

(72) Inventor: Wei-Chih Hsu, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 243 days.

(21) Appl. No.: 13/862,866

(22) Filed: Apr. 15, 2013

(65) Prior Publication Data

US 2013/0284314 A1 Oct. 31, 2013

(30) Foreign Application Priority Data

Apr. 26, 2012 (TW) ..... 101114832 A

(51) Int. Cl.
*B67D 3/00* (2006.01)
*A47G 19/22* (2006.01)

(52) U.S. Cl.
CPC ..... *B67D 3/0025* (2013.01); *A47G 19/22* (2013.01); *A47G 19/2205* (2013.01)

(58) Field of Classification Search
CPC ..... B67D 3/02; B67D 3/0025; B67D 3/0029
USPC ..... 141/319, 351, 352, 356, 363–366; 222/501, 181.1
See application file for complete search history.

(56) References Cited

U.S. PATENT DOCUMENTS 2,453,080 A * 11/1948 Shimp ..... 222/185.1
2,469,746 A * 5/1949 Sanchis ..... 141/296
2,547,744 A * 4/1951 Burger ..... 141/360
3,042,085 A * 7/1962 Morris ..... 141/353
3,217,939 A * 11/1965 Murray ..... 222/167
4,717,051 A * 1/1988 Leclerc ..... 222/545
4,723,694 A 2/1988 Sykes
5,154,212 A * 10/1992 Weber ..... 141/353
5,379,813 A * 1/1995 Ing ..... 141/351
5,431,205 A * 7/1995 Gebhard ..... 141/351
5,669,427 A * 9/1997 Hasper et al. ..... 141/364
5,960,742 A * 10/1999 O'Rourke et al. ..... 119/74
6,131,774 A * 10/2000 Thomas et al. ..... 222/181.2
6,585,016 B1 * 7/2003 Falligant et al. ..... 141/352
7,967,172 B2 * 6/2011 Albaum ..... 222/514

FOREIGN PATENT DOCUMENTS

JP 54-157066 U 1/1981
JP 6-11873 U 2/1994
JP 2009-56294 A 3/2009
JP 2013-91762 A 5/2013
KR 20-2010-0001554 U 2/2010

* cited by examiner

*Primary Examiner* — Timothy L Maust

(74) *Attorney, Agent, or Firm* — Novak Druce Connolly Bove + Quigg LLP

(57) ABSTRACT

A water container includes a bottle body containing water and a bottle mouth, a cup body detachably assembled to the bottle body, and a valve assembly secured to the bottle mouth. The valve assembly includes a ball and an elastic member. The ball and the elastic member are received in the receiving cavity. The elastic member is pressed between the ball the upper case and biases the ball towards sealing the opening. When the cup body is pushed toward the bottle body, the cup body drives the ball to unseal, to allow flow of water into the cup with no risk of spillage.

18 Claims, 4 Drawing Sheets

WATER CONTAINER

BACKGROUND

1. Technical Field

The disclosure generally relates to water containers, and particularly to a water container having a function of preventing water spilling out when pouring the water.

2. Description of Related Art

Water can be poured from a bottle to a cup to drink. In a static environment, the water usually will not spill out of the cup. However, while pouring water in a moving environment such as on a train or in a car, the water may easily spill out of the cup.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
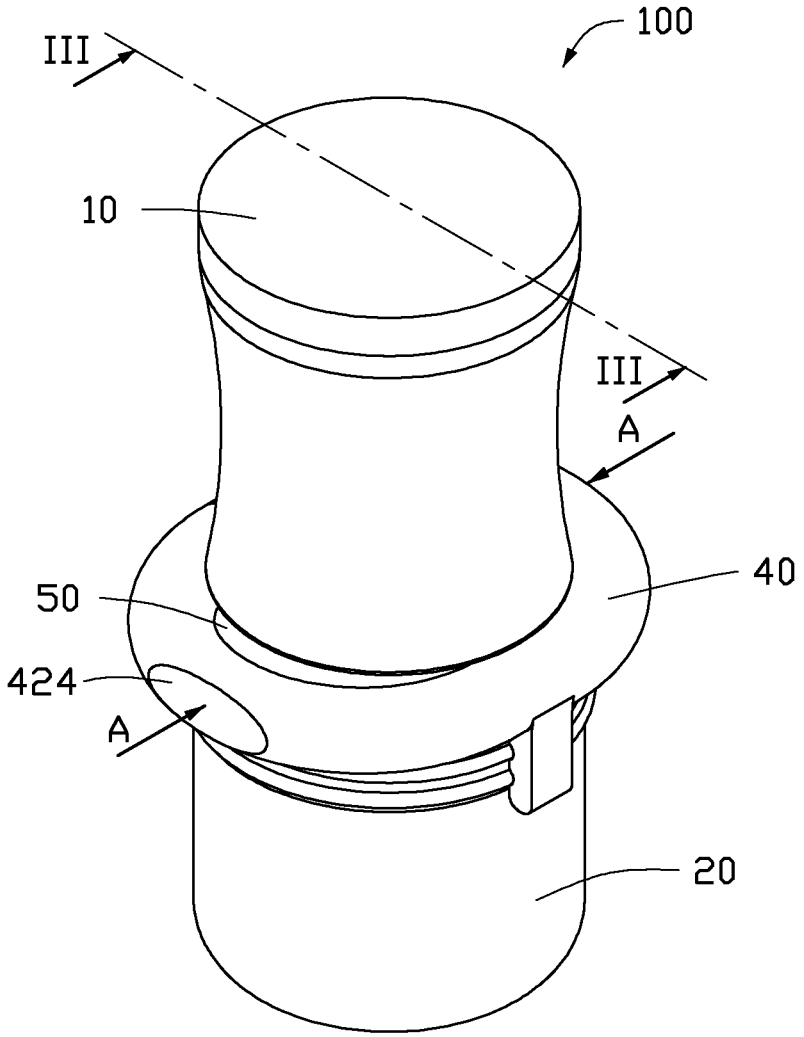
FIG. 1 is a schematic view of a water container, according to an exemplary embodiment of the disclosure.
Figure 2:
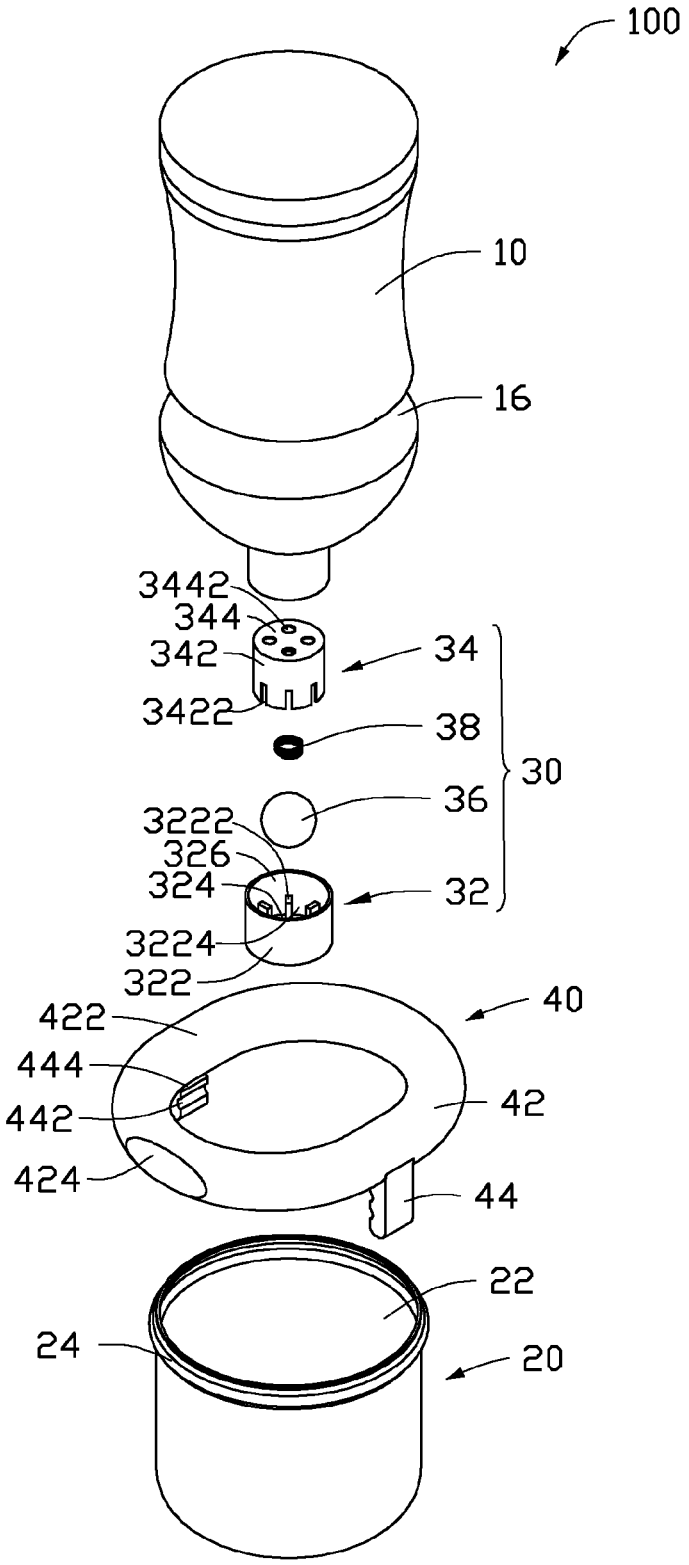
FIG. 2 is an exploded view of the water container in FIG. 1.

FIG. 1 is a schematic view of a water container 100, according to an exemplary embodiment of the disclosure. Referring to FIG. 2, the water container 100 includes a bottle body 10, a cup body 20, a valve assembly 30, and a latching member 40. The bottle body 10 is configured to contain water. The cup body 20 clips onto the bottle body 10. The valve assembly 30 is secured to the bottle body 10 to control the flow of water from the bottle body 10 or prevent water flowing from the bottle body 10. The latching member 40 is secured to the bottle body 10 and also latches the cup body 20 to the bottle body 10.

Figure 3:
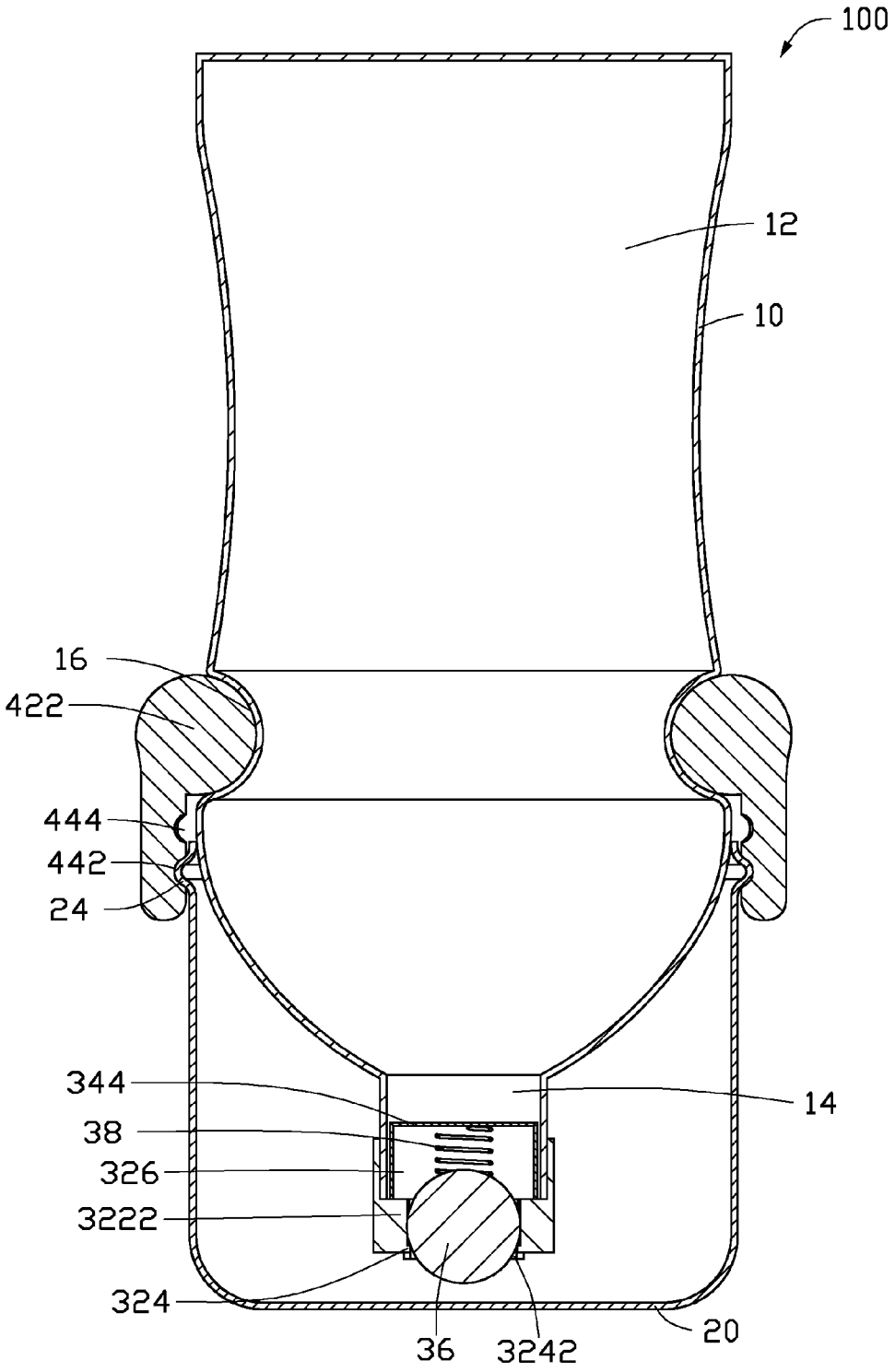
FIG. 3 is a cross-sectional view of the water container in FIG. 1 along line III.

Referring to FIG. 3, the bottle body 10 includes a water containing chamber 12 configured to contain the water and a bottle mouth 14 formed at an end of the bottle body 10. The bottle mouth 14 communicates with the water containing chamber 12 and water from the water containing chamber 12 flows out through the bottle mouth 14. The bottle body 10 defines a ring-shaped securing slot 16 around an outer peripheral wall of the bottle body 10 adjacent to the bottle mouth 14. The securing slot 16 supports and holds the latching member 40.

The cup body 20 includes a water holding chamber 22 and a flange 24 protruding from an outer peripheral wall of the cup body 20. The flange 24 engages with the latching member 40 so that the cup body 20 can be latched to the bottle body 10.

The valve assembly 30 includes a bottom case 32, an upper case 34, a ball 36 and an elastic member 38. The bottom case 32 includes a first side wall 322 and a bottom wall 324. The first side wall 322 is substantially a cylinder protruding from a peripheral edge of the bottom wall 324. The first side wall 322 and the bottom wall 324 form a receiving cavity 326 configured to receive the ball 36 and the elastic member 38. The first side wall 322 includes a plurality of guiding rails 3222 protruding from an inner surface from the first side wall 322 and equally spaced with each other. The guiding rails 3222 guide the ball 36 in the receiving cavity 326. Every two adjacent guiding rails 3222 define a water flowing channel 3224 therebetween. The bottom wall 324 defines a through opening 3242 (see FIG. 3) in a center portion of the bottom wall 324.

The upper case 34 is substantially similar to the bottom case 32 and includes a second side wall 342 and an upper wall 344. The second side wall 342 is substantially a hollow cylinder protruding from a peripheral edge of the upper wall 344. The second side wall 342 defines a plurality of latching slots 3422 corresponding to the guiding rails 3222. The latching slots 3422 latch with the guiding plates 3222 and support the upper case 34 on the bottom case 32. The upper wall 344 defines a plurality of holes 3442.

The ball 36 and the elastic member 38 are received in the receiving cavity 326. The elastic member 38 is pressed between the upper wall 344 and the ball 36 and biases the ball 36 towards sealing the opening 3242 so that by default the valve assembly 30 is closed to stop the water flowing from the opening 3242. To pour the water from the bottle body 10 to the cup body 20 the ball 36 is depressed into the receiving cavity 326 against the force of spring 38 to unseal the opening 3242 so that the valve assembly 30 is opened to allow the flow of water from the opening 3242.

The latching member 40 includes a latching ring 42 and two opposite latching arms 44 perpendicularly extending down from one side of the latching ring 42. The latching ring 42 is elastic and includes two opposite latching sections 422 and two opposite operating sections 424. The latching sections 422 latch into the securing slot 16. Each operating section 424 defines a spacing 50 between the bottle body 422 and the latching ring 42. Each latching arm 44 is positioned on one of the latching sections 422. Each latching arm 44 defines a first latching slot 442 and a second latching slot 444. The two first latching slots 442 are opposite and far away from the latching ring 42. The two second latching slots 444 are opposite and adjacent to the latching ring 42. Either the first latching slots 442 or the second latching slots 444 may engage with the flange 24 so that the cup body 20 is latched to the bottle body 10.

Figure 4:
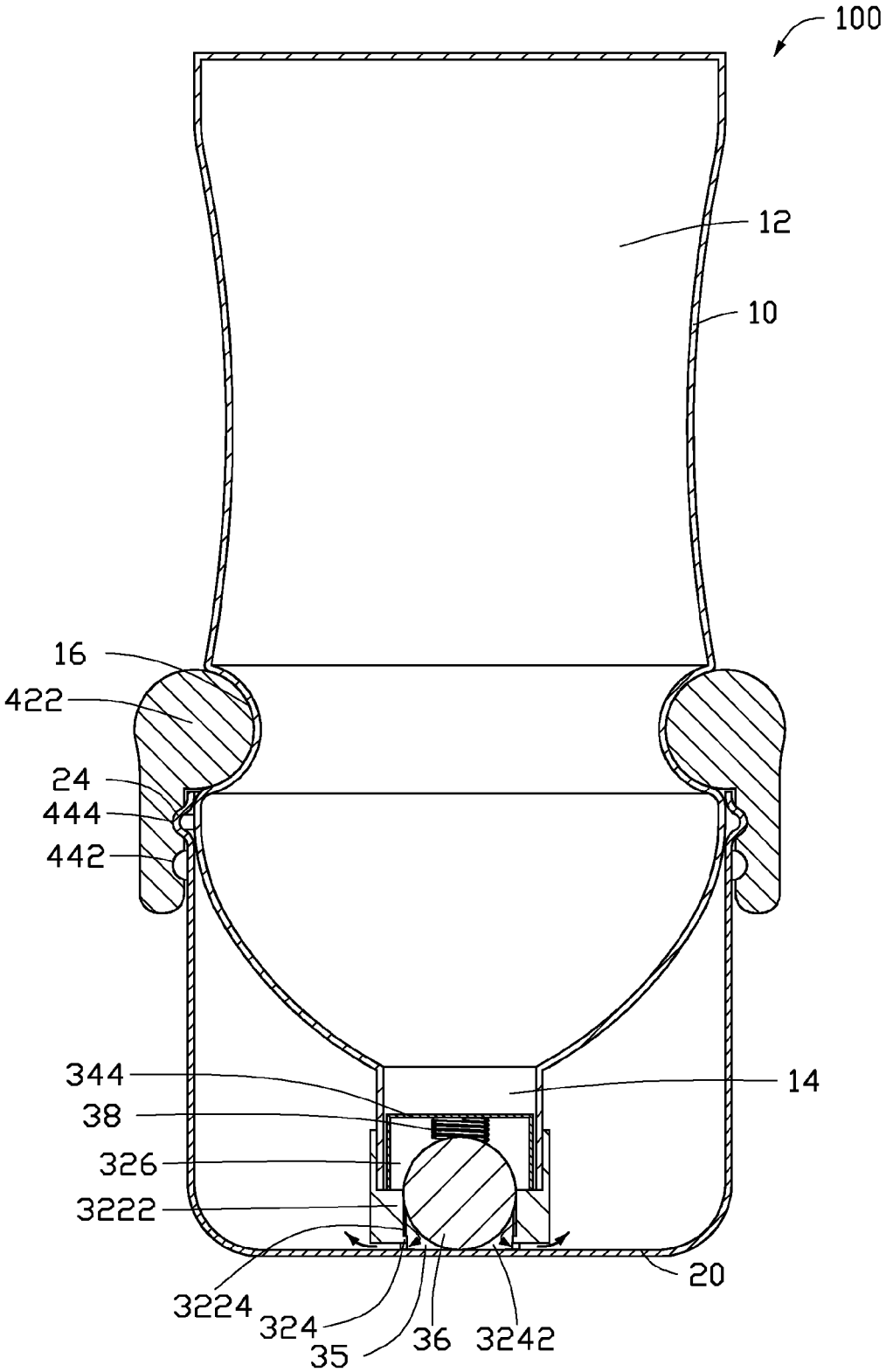
FIG. 4 is similar to FIG. 3, but showing a valve assembly of the water container opened.

Referring to FIGS. 3 and 4, to assemble the valve assembly 30, the ball 36 and the elastic member 38 are received in the receiving cavity 326. The guiding rails 3222 are latched into the latching slots 3422 so that the elastic member 38 is pressed between the upper wall 344 and the ball 36. The pressed elastic member 38 biases the ball 36 towards sealing the opening 3242.

To assemble the water container 100, the first side wall 322 of the assembled valve assembly 30 is sleeved around the bottle mouth 14 by threads (not shown) so that the valve assembly 30 is secured to the bottle mouth 14. The latching ring 42 is latched into the securing slot 16 with the latching arms 44 facing the bottle mouth 14. The cup body 20 covers the bottle mouth 14, with the flange 24 latched to the first latching slots 442 so that the cup body 20 is assembled to the bottle body 10.

In use, to pour water from the bottle body 10, the cup body 20 is located below the bottle body 10. The cup body 20 is pressed toward the bottle body 10 so that the flange 24 disengages from the first latching slots 442 and engages with the second latching slots 444. During the movement, the base of the cup body 20 biases the ball 36, and the ball 36 slides into the receiving cavity 326 along the guiding rails 3222. The elastic member 38 is further compressed and gap 35 (i.e. a portion of the opening 3242) appears between the ball 36 and the bottom wall 324. The water in the bottle body 10 can flow through the holes 3442, the channels 3224, and the gap 35, and finally into the cup body 20. To remove the cup body 20 from the bottle body 10 for drinking, the operating sections 424 can be pressed by an external force along directions A as shown in FIG. 1 to disengage the latching arms 44 from the flange 24. Meanwhile, the elastic member 38 will restore the ball 36 towards sealing the opening 3242 again.

During the process of pouring water, the water can flow only into the cup body 20, which is itself sealed to the bottle body 10, so that water will not spill out of the cup body 20.

The cup body 20 and the valve assembly 30 can be removed from the bottle body 10, and water can be poured out of the bottle body 10 directly through the bottle mouth 14.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A water container, comprising:

a bottle body comprising a water containing chamber and a bottle mouth;

a cup body removably clipped onto the bottle body, the cup body comprising a flange protruding from an outer peripheral wall of the cup body;

a valve assembly secured to the bottle mouth, the valve assembly controlling the flow of water out from the bottle body, the valve assembly comprising:

a bottom case defining a receiving cavity and an opening communicating with the receiving cavity;

an upper case defining a plurality of holes, the upper case secured to the bottom case, the holes communicating with the receiving cavity;

a ball; and an elastic member, the ball and the elastic member received in the receiving cavity; wherein the elastic member is pressed between the ball the upper case and biases the ball towards sealing the opening, when the cup body is moved toward the bottle body, the cup body drives the ball to slide into the receiving cavity to unseal the opening; and a latching member secured to the bottle body, the latching member comprising two opposite latching arms, each latching arm defining a first latching slot and a second latching slot;

wherein when the flange engages with the first latching slots, the ball seals the opening, and when the flange engages with the second latching slots, the ball unseals the opening.

2. The water container of claim 1, wherein the bottom case comprises a first side wall and a bottom wall, the first side wall and the bottom wall form the receiving cavity, the first side wall is sleeved around the bottle mouth.

3. The water container of claim 2, wherein the first side wall comprises a plurality of guiding rails longitudinally protruding from an inner surface from the first side wall spaced with each other, the ball slides into the receiving cavity along the guiding rails.

4. The water container of claim 3, wherein every two adjacent guiding rails define a channel allowing the flow of water from the water containing chamber to the opening when the opening is unsealed.

5. The water container of claim 4, wherein the cup body and the bottom wall define a gap communicating with the cup body, the water from the water containing chamber flows into the cup body through the gap.

6. The water container of claim 3, wherein the upper case comprises a second side wall and an upper wall, the second side wall longitudinally defines a plurality of latching slots corresponding to the guiding rails, the guiding rails latch into the corresponding latching slots.

7. The water container of claim 6, wherein the bottle body defines a securing slot around an outer peripheral wall of the bottle body, the latching member further comprises a latching ring, the latching ring latches into the securing slot.

8. A water container, comprising:

a bottle body comprising a water containing chamber and a bottle mouth;

a cup body comprising a water holding chamber, the cup body detachably assembled to the bottle body;

a valve assembly secured to the bottle mouth, the valve assembly controlling the flow of water out from the bottle body, the valve assembly comprising:

a bottom case defining a receiving cavity and an opening communicating with the receiving cavity;

an upper case defining a plurality of holes, the upper case secured to the bottom case, the holes communicating with the receiving cavity;

a ball; and an elastic member, the ball and the elastic member received in the receiving cavity; and a latching member secured to the bottle body, wherein the latching member comprises two opposite latching arms, each latching arm defines a first latching slot and a second latching slot; wherein when the cup body latches into the first latching slots, the elastic member is pressed between the ball the upper case and biases the ball towards sealing the opening; when the cup body latches into the second latching slots, the cup body resists the ball to slide into the receiving cavity to unseal the opening.

9. The water container of claim 8, wherein the bottom case comprises a first side wall and a bottom wall, the first side wall and the bottom wall form the receiving cavity, the first side wall is sleeved around the bottle mouth.

10. The water container of claim 9, wherein the first side wall comprises a plurality of guiding rails longitudinally protruding from an inner surface from the first side wall spaced with each other, the ball slides into the receiving cavity along the guiding rails.

11. The water container of claim 10, wherein every two adjacent guiding rails define a channel allowing the flow of water from the water containing chamber to the opening when the opening is unsealed.

12. The water container of claim 11, wherein the cup body and the bottom wall define a gap communicating with the cup body, the water from the water containing chamber flows into the cup body through the gap.

13. The water container of claim 12, wherein the upper case comprises a second side wall and an upper wall, the second side wall longitudinally defines a plurality of latching slots corresponding to the guiding rails, the guiding rails latch into the corresponding latching slots.

14. The water container of claim 8, wherein the bottle body defines a securing slot around an outer peripheral wall of the bottle body, the latching member further comprises a latching ring, the latching ring latches into the securing slot.

15. A water container, comprising:

a bottle body comprising a water containing chamber and a bottle mouth;

a cup body removably clipped onto the bottle body; and a valve assembly secured to the bottle mouth, the valve assembly controlling the flow of water out from the bottle body, the valve assembly comprising:

a bottom case defining a receiving cavity and an opening communicating with the receiving cavity, wherein the bottom case comprises a first side wall and a bottom wall, the first side wall and the bottom wall form the receiving cavity, the first side wall is sleeved around the bottle mouth, the first side wall comprises a plurality of guiding rails longitudinally protruding from an inner surface from the first side wall spaced with each other, the ball slides into the receiving cavity along the guiding rails;

an upper case defining a plurality of holes, the upper case secured to the bottom case, the holes communicating with the receiving cavity, wherein the upper case comprises a second side wall and an upper wall, the second side wall longitudinally defines a plurality of latching slots corresponding to the guiding rails, the guiding rails latch into the corresponding latching slots;

a ball; and an elastic member, the ball and the elastic member received in the receiving cavity; wherein the elastic member is pressed between the ball the upper case and biases the ball towards sealing the opening, when the cup body is moved toward the bottle body, the cup body drives the ball to slide into the receiving cavity to unseal the opening.

16. The water container of claim 15, wherein every two adjacent guiding rails define a channel allowing the flow of water from the water containing chamber to the opening when the opening is unsealed.

17. The water container of claim 15, wherein the cup body and the bottom wall define a gap communicating with the cup body, the water from the water containing chamber flows into the cup body through the gap.

18. The water container of claim 15, wherein the bottle body defines a securing slot around an outer peripheral wall of the bottle body, the latching member further comprises a latching ring, the latching ring latches into the securing slot.

* * * * *